US005938314A

United States Patent [19]

Lin

[11] Patent Number: 5,938,314

[45] Date of Patent: Aug. 17, 1999

[54] GANG LAMP ASSEMBLY

[76] Inventor: Mei-Lu Lin, 56, Min Sheng Street, Fengyuan, Taichung Shien, Taiwan, 420

[21] Appl. No.: 08/926,600

[22] Filed: Aug. 24, 1997

[51] Int. Cl.[6] ..... F21V 21/00

[52] U.S. Cl. ..... 362/249; 362/226; 439/699.2

[58] Field of Search ..... 362/234, 238, 362/239, 226, 249, 253, 252, 250, 391, 806; 439/699.2

[56] References Cited

U.S. PATENT DOCUMENTS

| | | | |
|---|---|---|---|
| 4,118,764 | 10/1978 | Bleiweiss et al. | 362/369 |
| 5,416,678 | 5/1995 | Schabowski | 362/249 |
| 5,791,940 | 7/1998 | Chen et al. | 439/619 |

*Primary Examiner*—Sandra O'Shea
*Assistant Examiner*—Todd Reed Hopper

[57] ABSTRACT

A gang lamp assembly has a gang lamp socket, a first decoration lamp, and a second decoration lamp. The gang lamp socket has a first socket, a second socket, a first insertion recess, a first insertion groove, a second insertion recess, a second insertion groove, and a slot. A U-shaped plate is inserted in the slot. The first decoration lamp has a first lamp holder, a first bulb disposed on the first lamp holder, and two first copper plates disposed on the first lamp holder. The second decoration lamp has a second lamp holder, a second bulb disposed on the second lamp holder, and two second copper plates disposed on the second lamp holder. The first lamp holder is inserted in the first socket. The second lamp holder is inserted in the second socket. A first flat conductive plate is inserted in the first insertion recess. A second flat conductive plate is inserted in the second insertion recess.

1 Claim, 9 Drawing Sheets

GANG LAMP ASSEMBLY

BACKGROUND OF THE INVENTION

This invention relates to a gang lamp assembly, and more particularly to a gang lamp assembly which contains a plurality of decoration lamps.

A conventional twin lamp assembly has two sockets side by side. However, each socket has two wires. The user may combine four sockets together with eight wires. Therefore, it is difficult to arrange a large number of wires in order.

SUMMARY OF THE INVENTION

An object of this invention is to provide a gang lamp assembly which can reduce the numbers of wires significantly.

Another object of this invention is to provide a gang lamp assembly which has only two wires for a plurality of decoration lamps.

DETAILED DESCRIPTION OF THE INVENTION

Figure 1:
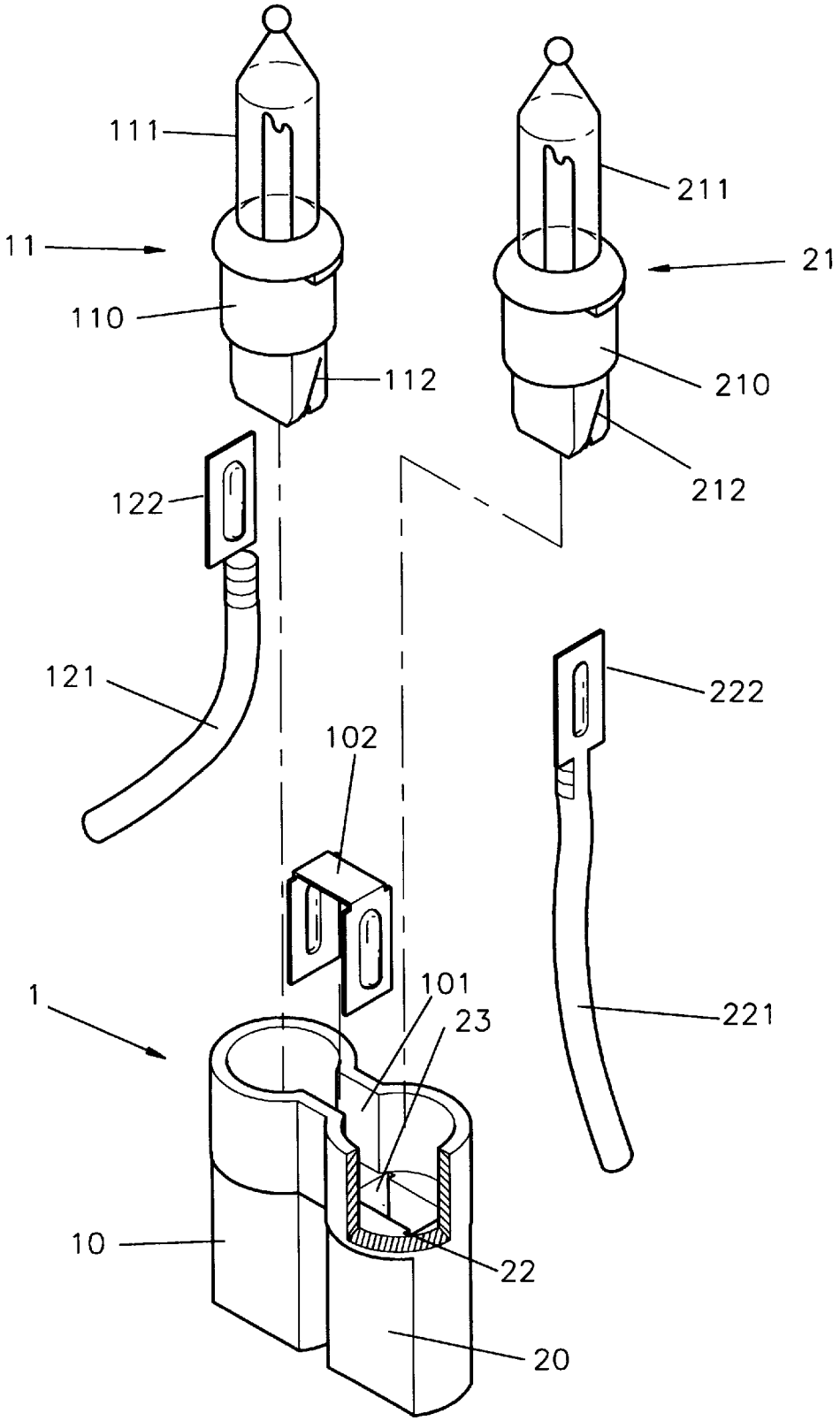
FIG. 1 is a perspective exploded view of a gang lamp assembly of a first embodiment.
Figure 2:
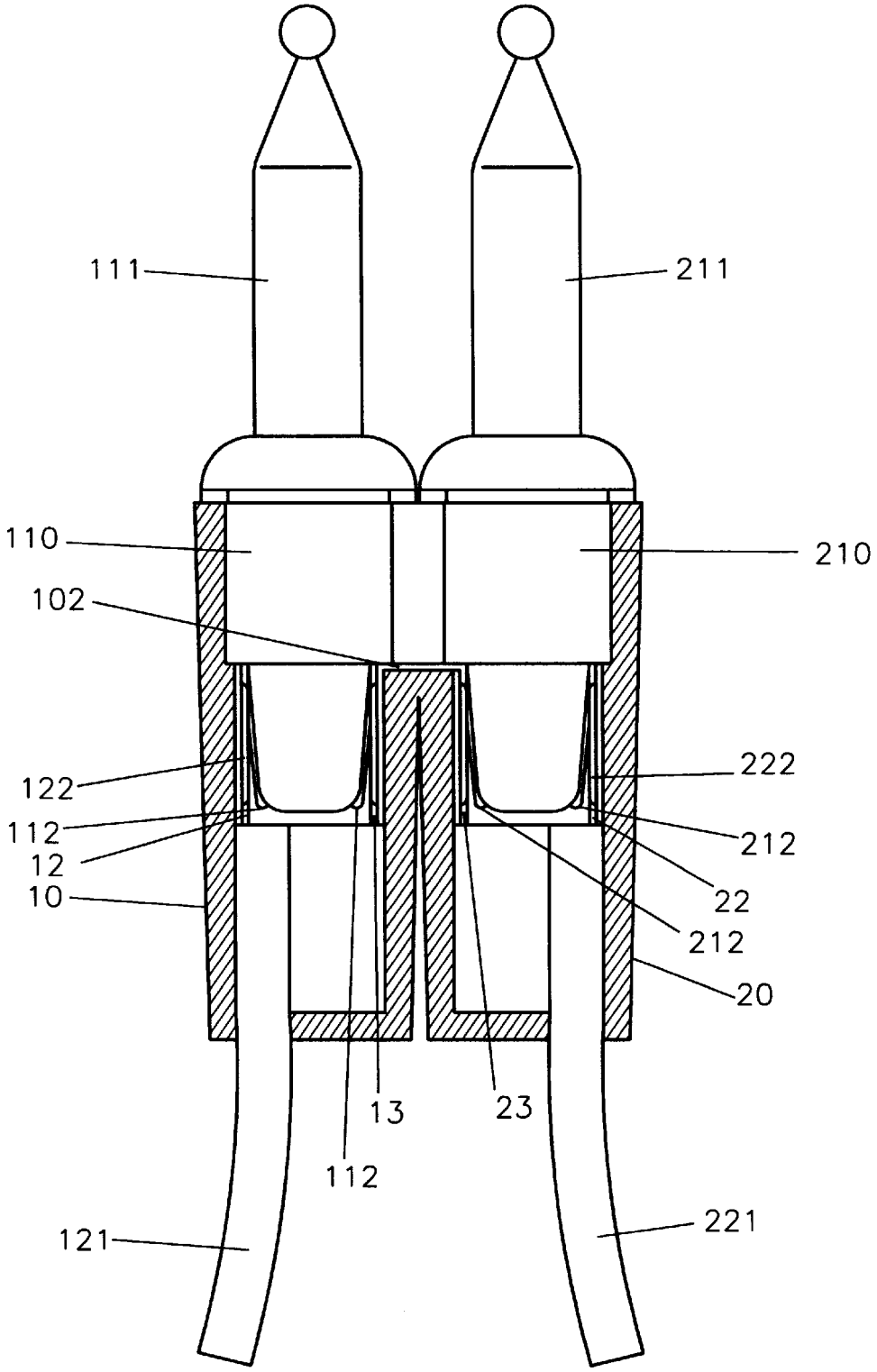
FIG. 2 is a sectional assembly view of a gang lamp assembly of a first embodiment.
Figure 3:
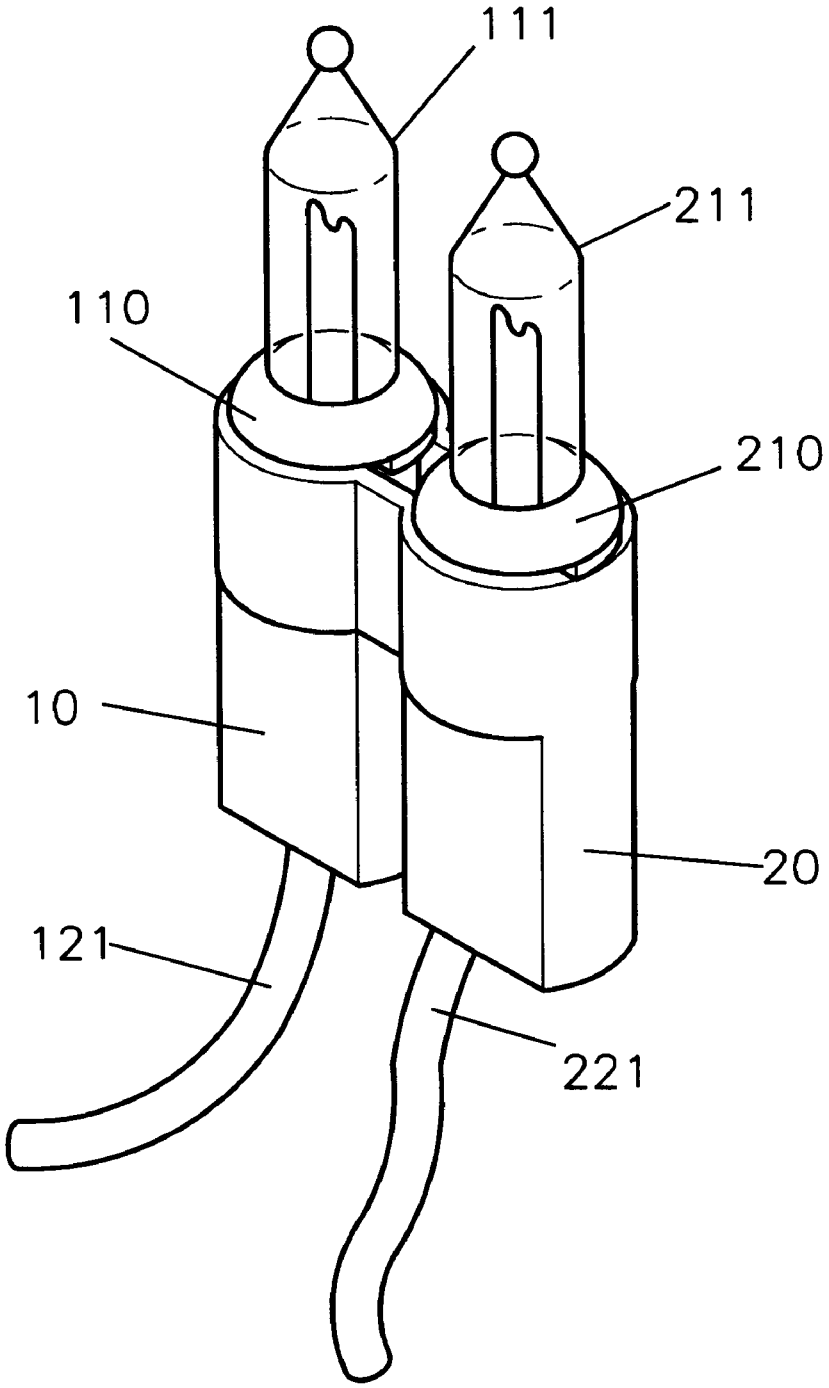
FIG. 3 is a perspective assembly view of a gang lamp assembly of a first embodiment.

Referring to FIGS. 1 to 3, a first gang lamp assembly comprises a gang lamp socket 1, a first decoration lamp 11, and a second decoration lamp 21. The gang lamp socket 1 has a first socket 10, a second socket 20 connected to the first socket 10, a first insertion recess 12 formed in the first socket 10, a first insertion groove 13 formed in the first socket 10, a second insertion recess 22 formed in the second socket 20, a second insertion groove 23 formed in the second socket 20, and a slot 101 formed between the first socket 10 and the second socket 20. A U-shaped plate 102 is inserted in the slot 101. The first decoration lamp 11 has a first lamp holder 110, a first bulb 111 disposed on the first lamp holder 110, and two first copper plates 112 disposed on two laterals of the first lamp holder 110. The second decoration lamp 21 has a second lamp holder 210, a second bulb 21 disposed on the second lamp holder 210, and two second copper plates 212 disposed on two laterals of the second lamp holder 210. A first flat conductive plate 122 is connected to a first wire 121. A second flat conductive plate 222 is connected to a second wire 221. The first lamp holder 110 is inserted in the first socket 10. The second lamp holder 210 is inserted in the second socket 20. The first flat conductive plate 122 is inserted in the first insertion recess 12. The second flat conductive plate 222 is inserted in the second insertion recess 22. One first copper plate 112 contacts the first flat conductive plate 122, and the other first copper plate 112 contacts the U-shaped plate 102. One second copper plate 212 contacts the second flat conductive plate 222, and the other second copper plate 212 contacts the U-shaped plate 102.

Figure 4:
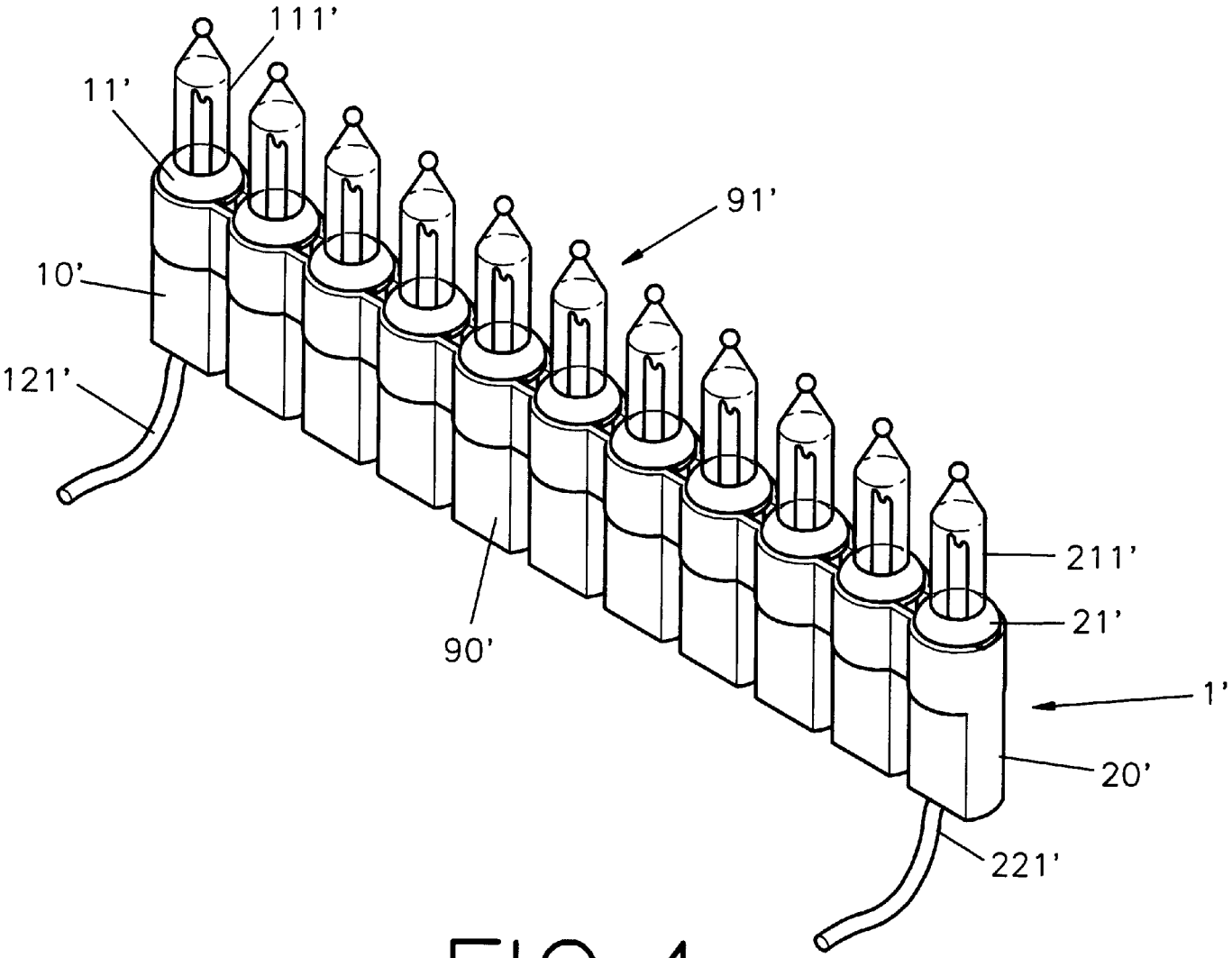
FIG. 4 is a perspective assembly view of a gang lamp assembly of a second embodiment.

Referring to FIG. 4, a second gang lamp assembly comprises a gang lamp socket 1', a first decoration lamp 11', a second decoration lamp 21', and a plurality of third decoration lamps 91'. The gang lamp socket 1' has a first socket 10', a second socket 20', and a plurality of third sockets 90'. The third decoration lamps 91' are disposed on the third sockets 90' respectively. The first decoration lamp 11' is disposed on the first socket 10'. The second decoration lamp 21' is disposed on the second socket 20'. The first decoration lamp 11' has a first bulb 111'. The second decoration lamp 21' has a second bulb 211'. A first wire 121' is extended from the first socket 10'. A second wire 221' is extended from the second socket 20'.

Figure 5:
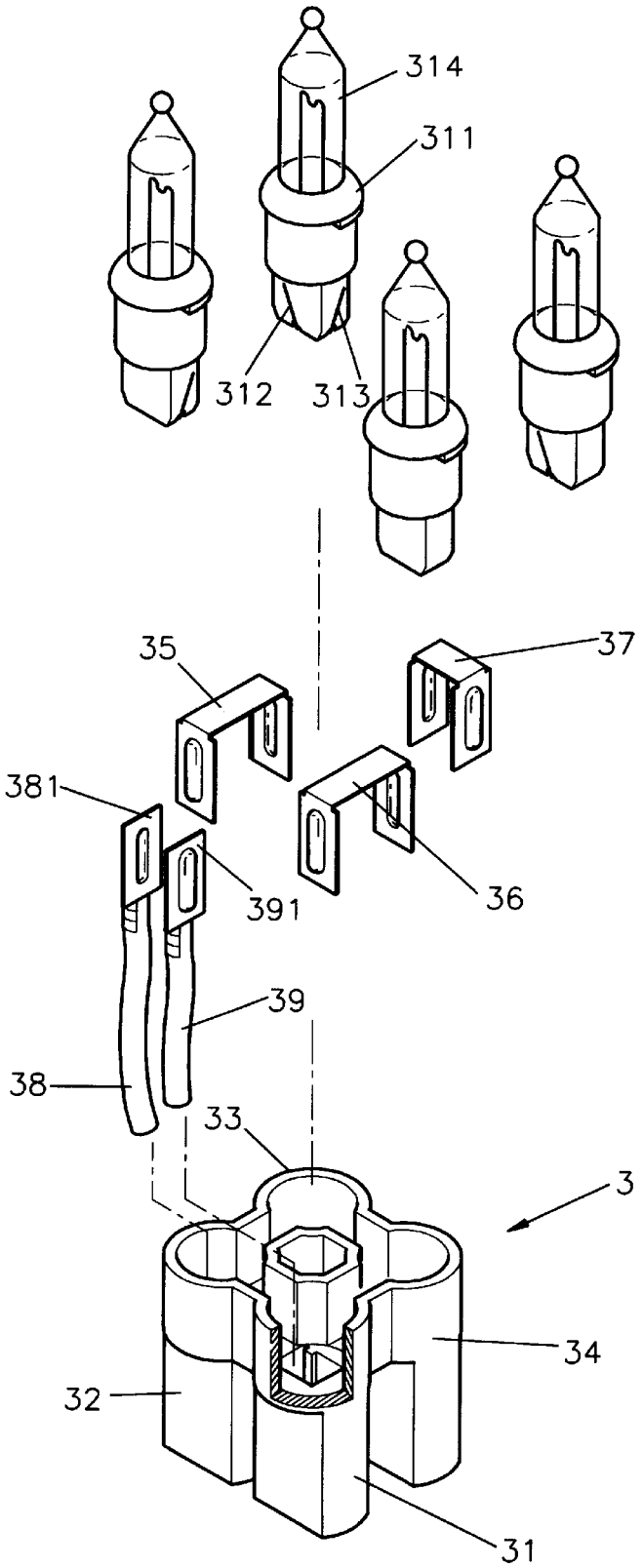
FIG. 5 is a perspective exploded view of a gang lamp assembly of a third embodiment.
Figure 6:
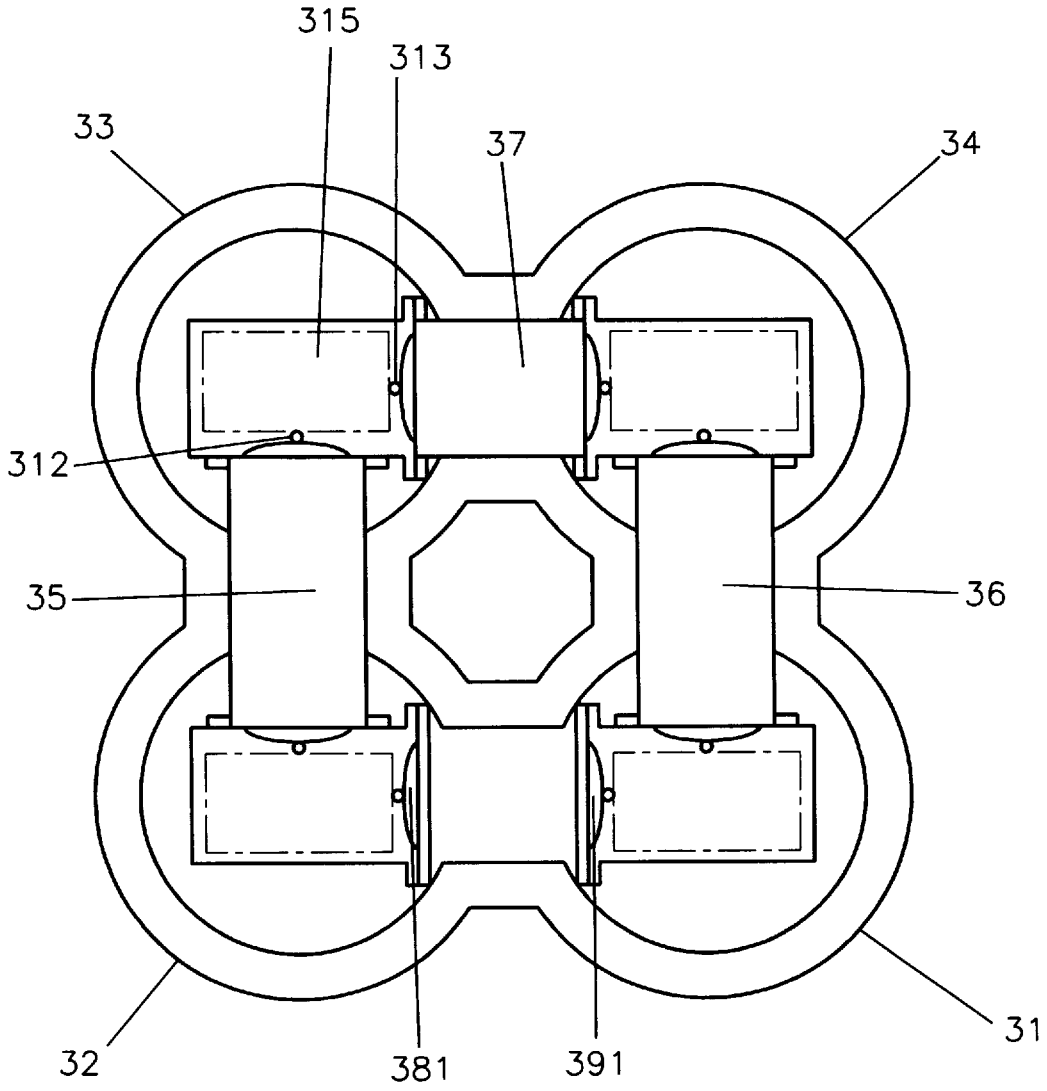
FIG. 6 is an elevational view of FIG. 5.

Referring to FIGS. 5 and 6, a third gang lamp assembly comprises a gang lamp socket 3 and four decoration lamps 311. The gang lamp socket 3 has a first socket 31, a second socket 32, a third socket 33, and a fourth socket 34. The sockets 31, 32, 33 and 34 receive the corresponding decoration lamps 311 respectively. Each decoration lamp 311 has a bulb 314 and two copper plates 312 and 313. A plurality of U-shaped plates 35, 36 and 37 are inserted in the gang lamp socket 3. A first flat conductive plate 381 is connected to a first wire 38. A second flat conductive plate 391 is connected to a second wire 39. The first flat conductive plate 381 is inserted in the gang lamp socket 3. The second flat conductive plate 391 is inserted in the gang lamp socket 3.

Figure 7:
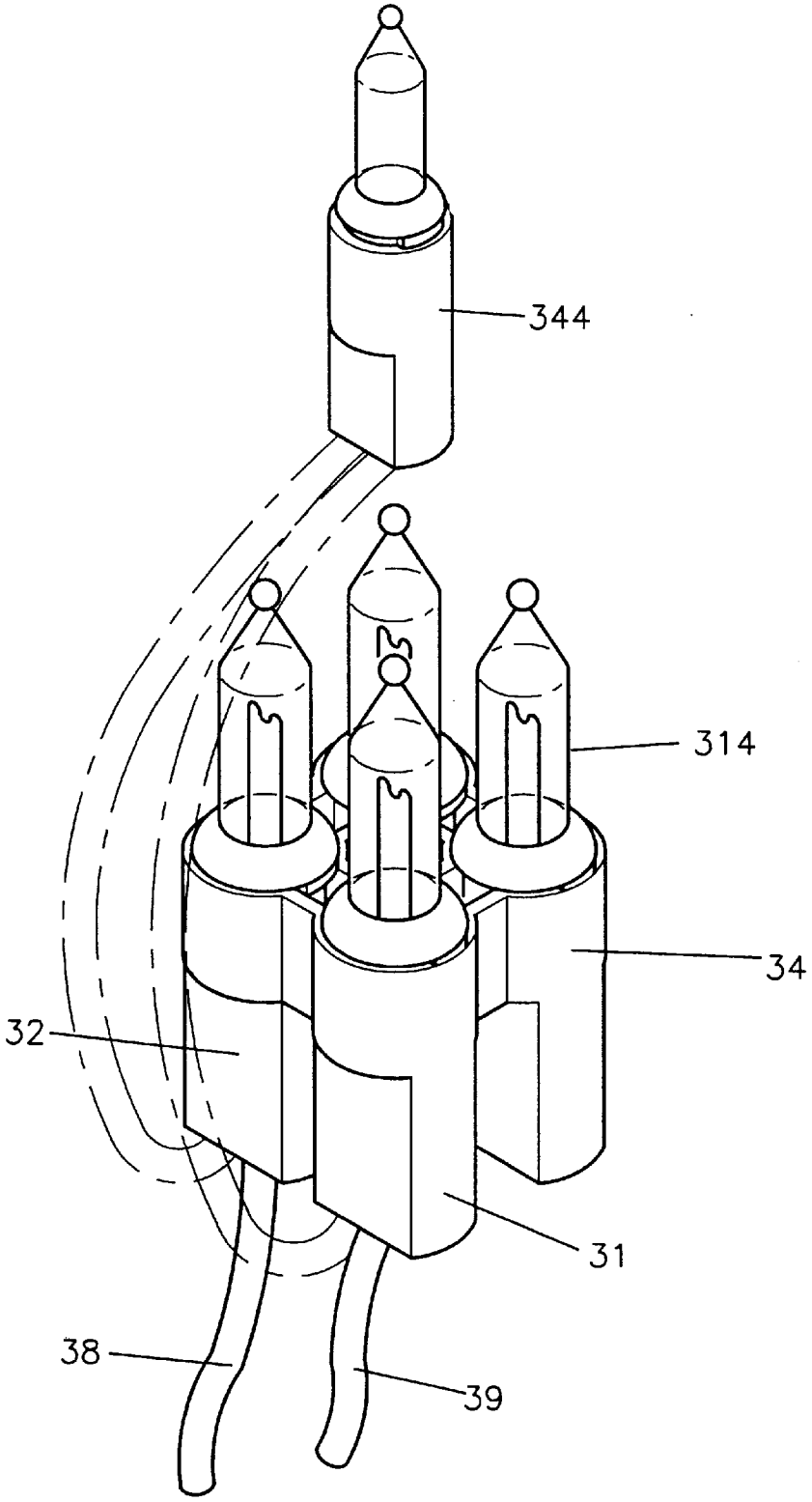
FIG. 7 is a perspective view of a gang lamp assembly of a third embodiment with an additional decoration lamp.

Referring to FIG. 7, an additional decoration lamp 344 is connected to the third gang lamp assembly via two additional wires.

Figure 9:
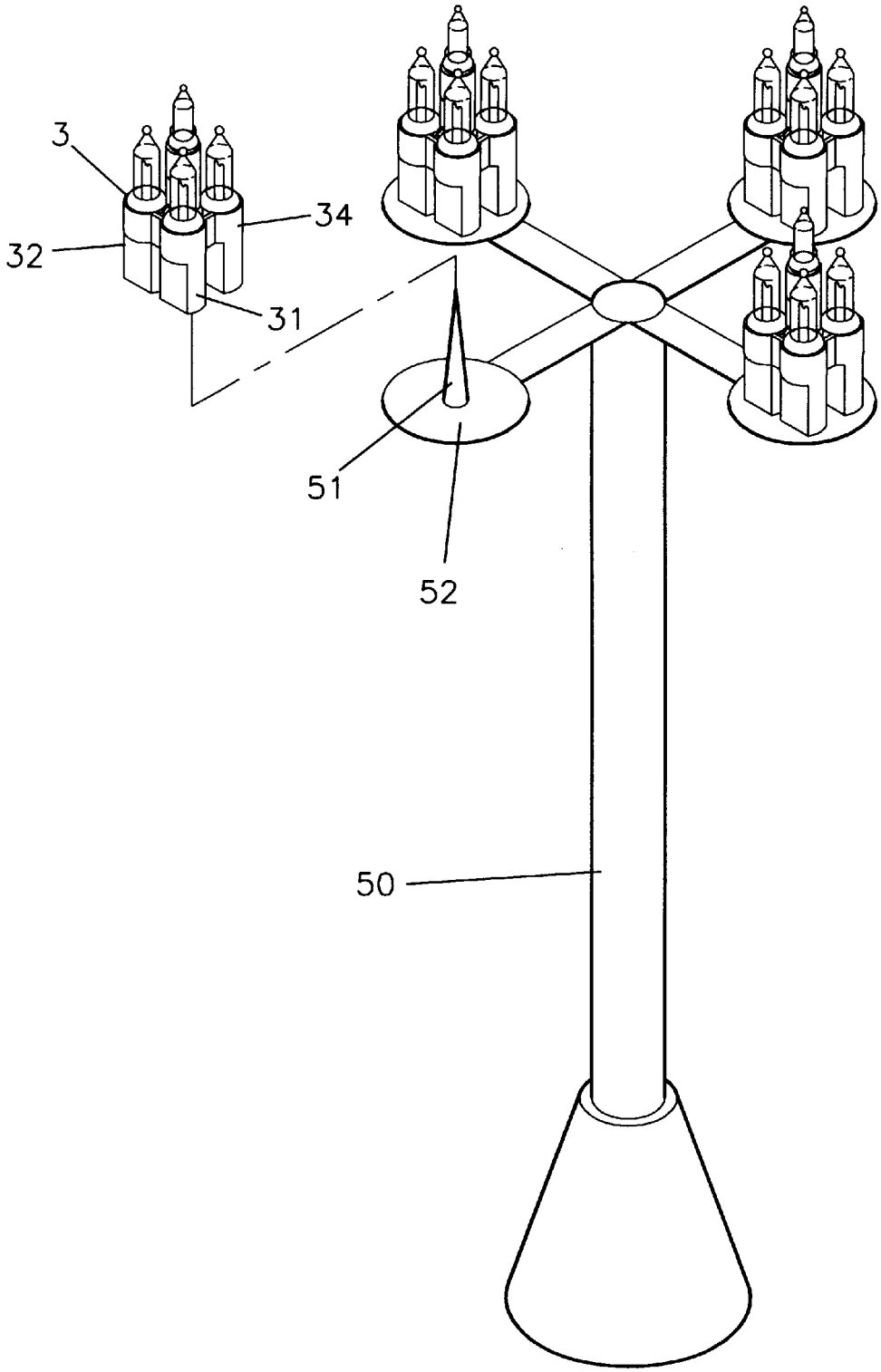
FIG. 9 is a schematic view illustrating a plurality of gang lamp assemblies of a third embodiment disposed on a candlestick.

Referring to FIG. 9, a candlestick 50 has a plurality of discs 52. Each disc 52 has a cone-shaped post 51. A plurality of third gang lamp assemblies are supported by the cone-shaped posts 51 respectively.

Figure 8:
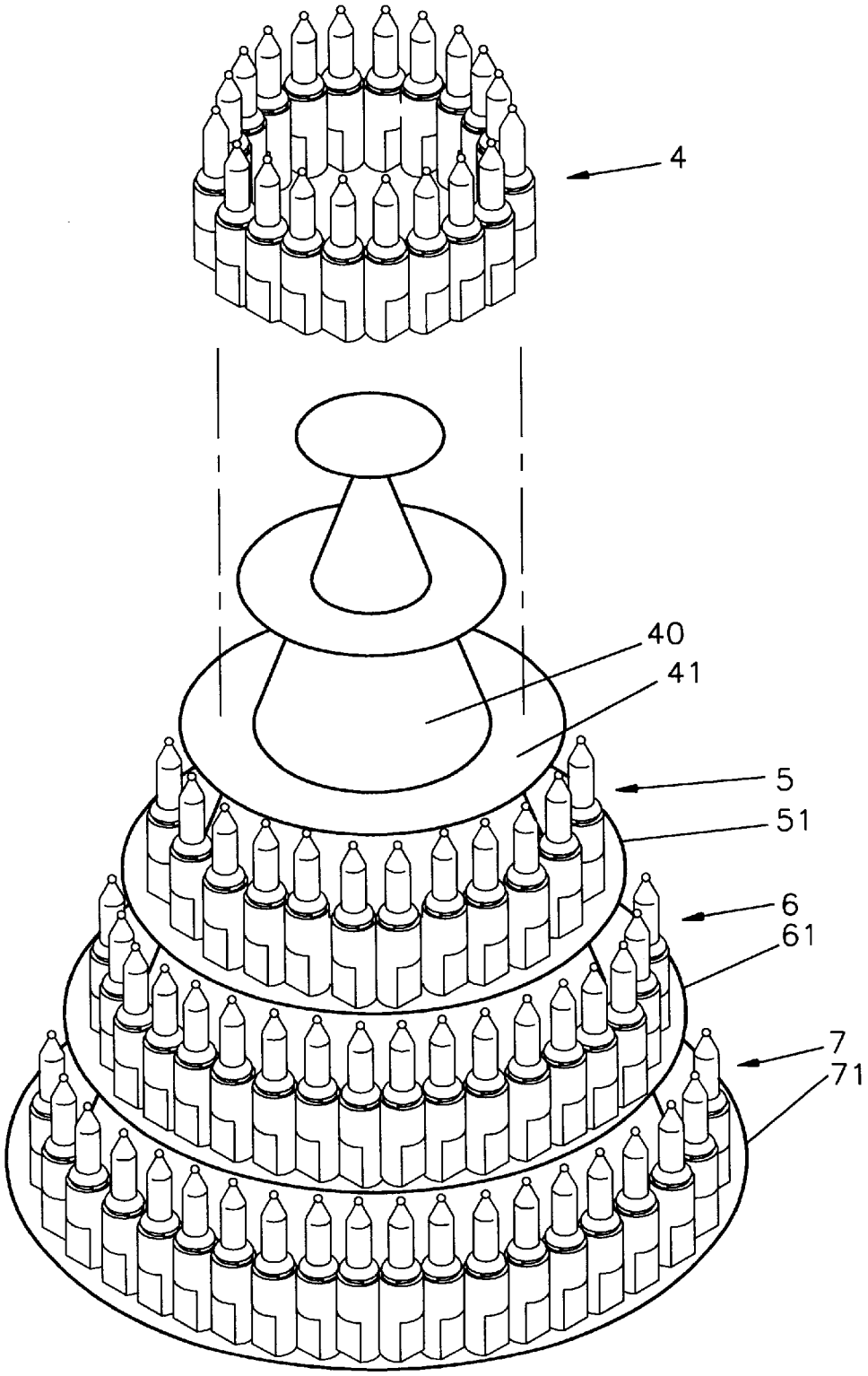
FIG. 8 is a perspective view of a gang lamp assembly of a fourth embodiment.

Referring to FIG. 8, a fourth gang lamp assembly 4 is arranged in an annular shape. A fifth gang lamp assembly 5 is arranged in an annular shape. A sixth gang lamp assembly 6 is arranged in an annular shape. A seventh gang lamp assembly 7 is arranged in an annular shape. A cone 40 are surrounded by a first disc 41, a second disc 51, a third disc 61 and a fourth disc 71. The fourth gang lamp assembly 4 is disposed on the first disc 41. A fifth gang lamp assembly 5 is disposed on the second disc 51. A sixth gang lamp assembly 6 is disposed on the third disc 61. The seventh gang lamp assembly 7 is disposed on the fourth disc 71.

I claim:

1. A gang lamp assembly comprises:

a gang lamp socket, a first decoration lamp, and a second decoration lamp, the gang lamp socket having a first socket, a second socket connected to the first socket, a first insertion recess formed in the first socket, a first insertion groove formed in the first socket, a second insertion recess formed in the second socket, a second insertion groove formed in the second socket, and a slot formed between the first socket and the second socket, a U-shaped plate inserted in the slot, the first decoration lamp having a first lamp holder, a first bulb disposed on the first lamp holder, and two first copper plates disposed on two laterals of the first lamp holder, the second decoration lamp having a second lamp holder, a second bulb disposed on the second lamp holder, and two second copper plates disposed on two laterals of the second lamp holder, a first flat conductive plate connected to a first wire, a second flat conductive plate connected to a second wire, the first lamp holder inserted in the first socket, the second lamp holder inserted in the second socket, the first flat conductive plate inserted in the first insertion recess, and the second flat conductive plate inserted in the second insertion recess.

* * * * *